United States Patent [19]

Svercl et al.

[11] Patent Number: 4,489,588

[45] Date of Patent: Dec. 25, 1984

[54] APPARATUS FOR MANUFACTURING SCREW WORKPIECES OF A TUBE SEMI-PRODUCT

[75] Inventors: Josef Svercl, Olomouc; Jan Novak, Trebcin; Stepan Zampach, Loucany, all of Czechoslovakia

[73] Assignee: SIGMA koncern, Olomouc, Czechoslovakia

[21] Appl. No.: 480,463

[22] Filed: Mar. 30, 1983

[30] Foreign Application Priority Data

Mar. 31, 1981 [CS] Czechoslovakia ..... 9357-81

[51] Int. Cl.[3] ..... B21K 1/12

[52] U.S. Cl. ..... 72/402

[58] Field of Search ..... 72/399, 402

[56] References Cited

U.S. PATENT DOCUMENTS

| | | | |
|---|---|---|---|
| 461,812 | 10/1891 | Burkhardt | 72/402 |
| 2,302,674 | 11/1942 | Carter | 72/402 |
| 2,733,458 | 2/1956 | Trurnit | 72/402 |
| 4,379,397 | 4/1983 | Langr | 72/402 |

FOREIGN PATENT DOCUMENTS

| | | | |
|---|---|---|---|
| 2081144 | 2/1982 | United Kingdom | 72/402 |

*Primary Examiner*—Lowell A. Larson

[57] ABSTRACT

Forming die for manufacturing screw workpieces of a tube semi-product, e.g. rotors of single-spindle pumps. The function cavity of the forming dies consists of a guide part, a forming part, and a calibrating part. The guide part of the function cavity is formed by the intersection of a cylindrical surface and a helix, the forming part is formed by the intersection of a conical surface and a helix, and the calibrating part is of the shape of the helix of the final product. A minimum length of the guide part of the function cavity is equal to the diameter of the cylindrical surface, but the minimum length of the forming part as well as the length of the calibrating part of the function cavity is equal to one lead of the helix. The ratio of the diameter of the cylindrical surface of the guide part to the diameter of the helix is at least 1.1:1.

4 Claims, 2 Drawing Figures

APPARATUS FOR MANUFACTURING SCREW WORKPIECES OF A TUBE SEMI-PRODUCT

Figure 1:
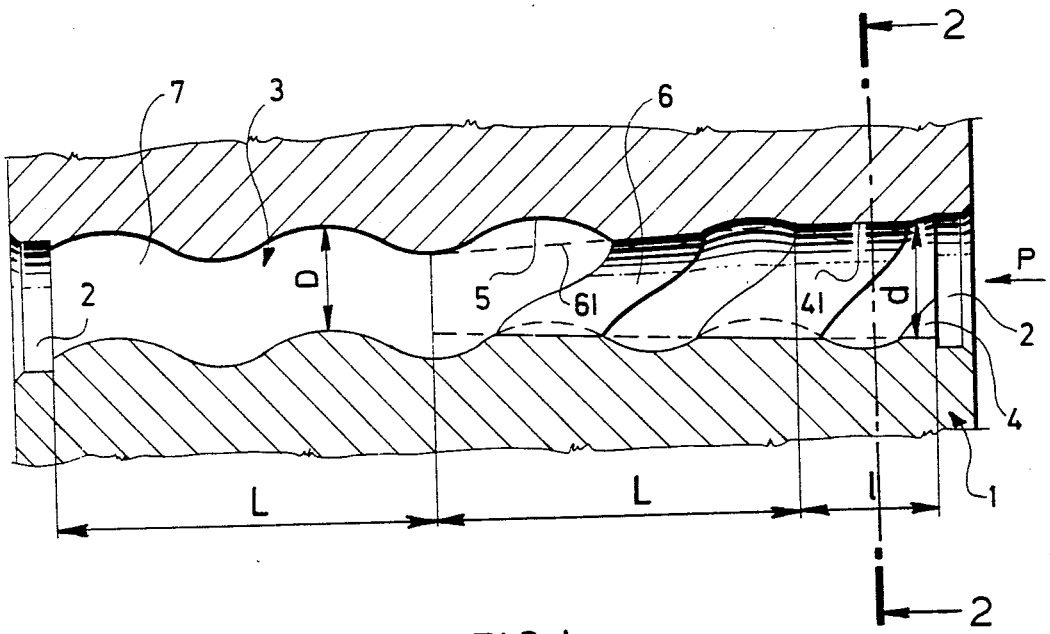

This application is related to the co-assigned U.S. patent applications of LANGR, Ser. Nos. 299,586, filed Sept. 4, 1981, now U.S. Pat. No. 4,379,397 granted Apr. 12, 1983, and 466,037, filed Feb. 14, 1983.

This invention relates to apparatus for manufacturing screw workpieces of a tube semi-product, e.g. rotors of single-spindle pumps.

When manufacturing single-spindle pumps, designers try both to apply the most progressive technology in the production of the pump, and also to diminish to a minimum the weight of the entire pump. There are known progressive production technologies for making rotors of single-spindle pumps, viz. by forming them when cold while using a tube semi-product as the initial workpiece. This technology provides the proper forming process by a successive pressing of a tube-semi-product in forming dies which are provided with a forming cavity, the shape of the cavity corresponding to the shape of the final product. The tube semi-product is guided in the forming dies, and is radially form-pressed into the desired shape while undergoing a simultaneous rotary motion and a step-wise motion in the forward direction. The following cavity of such forming dies is characterized by an entry part, where the change of shape is successively carried out from a straight tube into a helix, and by a calibrating part, which, in fact, affects the surface quality of the formed helix. To achieve a desired lead of the helix and the desired diameter thereof in a face section, the shape of the entry part of the forming cavity of the forming dies is a determining factor. Such forming dies are disclosed in Czechoslovak Pat. No. 136,995 (which corresponds to U.S. Pat. Nos. 3,606,789 and 3,740,811), which also discloses and claims a method for the production of screw bodies; Czechoslovak Pat. No. 200,064 also discloses such method and apparatus, the latter patent disclosing and claiming improvements upon Czechoslovak Pat. No. 136,995, which corresponds to the above-noted U.S. applications of LANGR.

The forming dies according to Czechoslovak Pat. No. 136,995 has a drawback in the entry part of the forming dies; such drawback resides in the fact that the final dimension of the helix must be formed successively in two or three passages of the semi-product through forming dies of various dimensions. The entry into the dies is not along a central line, and that is why the diameter of face sections of the forming dies in the entry part thereof is variable and difficult to manufacture.

When designing the shape of the forming cavity according to Czechoslovak Pat. No. 200,064, the shape of the entry part of the forming dies is rather complicated and is also difficult to manufacture, since it requires a variable lead of the helix, as well as a variable diameter and variable eccentricity. Another drawback of this design resides in the fact that in case of a defect, the shape of the helix does not allow the taking of a partially formed tube out of the forming dies without disassembling the dies.

The forming dies in accordance with the present invention overcome the drawbacks of the above-described hitherto known constructions of dies employed for the manufacturing of screw workpieces of tube semi-products, e.g. rotors of single-spindle pumps, said dies in accordance with the invention having a function cavity.

In accordance with the invention, the function cavity of the forming dies consists of a guide part, a forming part, and a calibrating part, the guide part of the function cavity being formed by the intersection of a cylindrical surface and a helix, the forming part being formed by the intersection of a conical surface and a helix, and the calibrating part being in the shape of the final helix.

In accordance with the invention, a minimum length of the guide part of the function cavity is equal to the diameter of the cylindrical surface, but the minimum length of the forming part, as well as of the calibrating part, of the function cavity is equal to one lead of the helix, that is, the pitch of the helix. Finally, the ration of the diameter of the cylindrical surface of the guide part to the diameter of the helix is at least 1.1:1.

Not only does the invention overcome all the drawbacks of the prior art mentioned above, but the production of such forming dies is simple and does not require any special production equipment. Their manufacture involves a considerably smaller amount of labor than dies of the prior art. The semi-product tubes may be formed by the dies of the invention into the desired final shape in only one operation.

Figure 2:
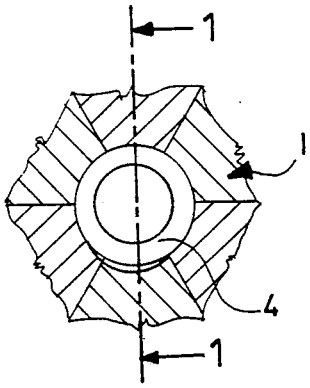

In order that the invention may be clearly understood and readily carried into effect, a preferred embodiment thereof is, by way of example, hereinafter more fully described and illustrated in the accompanying drawing, in which:

FIG. 1 is a view in longitudinal axial section through forming dies in accordance with the invention, the section being taken along the line 1—1 of FIG. 2, and FIG. 2 is a view in transverse section through the forming dies of FIG. 1, the section being taken along the line 2—2 in FIG. 1.

In accordance with the invention, a forming die 1, consisting of a number of parts (6 shown), is provided in its righthand, inlet end (FIG. 1) and in its outlet, left-hand end with central openings 2. Between the inlet and outlet openings 2 there is provided a metal deforming or function cavity 3. The function cavity 3 at its inlet, righthand end, is formed by a guide part 4, which is represented by the intersection of a cylindrical surface 41 and a helix 5. Further on, in the direction P, the guide part 4 merges into a forming part 6, which is formed by the intersection of a conical surface 61 and the helix 5. A calibrating part 7, to the left of forming part 6, merges at its entering end with part 6, and has the shape of the final helix 5. The ratio of the diameters d of the cylindrical part 41 of the guide part 4 to the diameter D of the helix 5 in the calibrating part 7 is at least 1.1:1. The minimum length 1 of the guide part 4 of the function cavity 3 is usually equal to one diameter of the cylindrical surface 41 of guide part 4. The forming part 6 and the calibrating part 7 are usually and preferably of a minimum length L, which is equal to one lead, that is the pitch, of the helix 5.

In forming a workpiece by the dies of the present invention, a straight and smooth tube, usually made of malleable metal, is put into the guide part 4 of the function cavity 3 of the forming dies 1, the tube being subjected to an axial feeding with respect to the die in the direction of arrow P in FIG. 1, and to a rotating motion of the tube relative to the die. This results in gradually reducing the diameter of the tube in forming part 6 of the die by an upsetting operation. Simultaneously, there are filled cavities of the helix 5 in the forming part 6 of the function cavity 3 by the tube being deformed, so that a perfectly shaped helix 5 of a desired diameter and lead (pitch) enters into the lefthand calibrating part 7. In the calibrating part 7 the surface of the formed helix 5 is merely smoothed.

Although the invention is described and illustrated with reference to a single preferred embodiment thereof, it is to be expressly understood that it is in no way limited to the disclosure of such preferred embodiment but is capable of numerous modifications within the scope of the appended claims.

We claim:

1. A forming die for manufacturing screw workpieces of a tube semi-product, said die having a function cavity provided with an inlet guide part, a forming part, and a calibrating part, the guide part of the function cavity being formed by the intersection of cylindrical surface and a helix, the forming part being formed by the intersection of a conical surface and a helix, and the calibrating part being of a shape of the final helix of the screw workpiece.

2. A die as in claim 1, wherein the minimum length of the guide part of the function cavity is equal to the diameter of the cylindrical surface, but the minimum length of the forming part, as well as of the calibrating part of the function cavity is equal to one lead of the helix.

3. A die as in claim 1, wherein the ratio of the diameter of the cylindrical surface of the guide part to the diameter of the helix is at least 1.1:1.

4. A die as in claim 2, wherein the ratio of the diameter of the cylindrical surface of the guide part to the diameter of the helix is at least 1.1:1.

* * * * *